US007992368B2

(12) United States Patent
Bentley

(10) Patent No.: US 7,992,368 B2
(45) Date of Patent: Aug. 9, 2011

(54) EQUINE TRAINING DEVICE

(75) Inventor: Hilary E. Bentley, Kidderminster (GB)

(73) Assignee: The University of Wolverhampton (GB)

( * ) Notice: Subject to any disclaimer, the term of this patent is extended or adjusted under 35 U.S.C. 154(b) by 644 days.

(21) Appl. No.: 11/912,201

(22) PCT Filed: Apr. 23, 2006

(86) PCT No.: PCT/GB2006/001458

§ 371 (c)(1),
(2), (4) Date: Apr. 2, 2008

(87) PCT Pub. No.: WO2006/114584

PCT Pub. Date: Nov. 2, 2006

(65) Prior Publication Data

US 2008/0250761 A1 Oct. 16, 2008

(30) Foreign Application Priority Data

Apr. 23, 2005 (GB) ..... 0508223.5

(51) Int. Cl.
*B68B 1/00* (2006.01)

(52) U.S. Cl. ..... 54/71; 54/58

(58) Field of Classification Search ..... 54/4, 35, 54/58, 71

See application file for complete search history.

(56) References Cited

U.S. PATENT DOCUMENTS

| | | | | |
|---|---|---|---|---|
| 378,153 | A * | 2/1888 | Tiffany | 119/724 |
| 815,164 | A * | 3/1906 | Hayner | 54/24 |
| 4,453,371 | A | 6/1984 | Abbott-Davies | |
| 5,519,986 | A | 5/1996 | Raffit | |
| 5,755,185 | A * | 5/1998 | Gallagher | 119/792 |
| 6,769,235 | B1 * | 8/2004 | Hayes | 54/71 |
| 6,789,378 | B1 | 9/2004 | Adams, Jr. | |

FOREIGN PATENT DOCUMENTS

DE 202004004443 U1 8/2004

(Continued)

OTHER PUBLICATIONS

McBane, Susan (1992) "The illustrated guide to horse tack" pp. 108-112.

UK Intellectual Property Office Examination Report, Oct. 10, 2008.

UK Intellectual Property Office Examination Report, Aug. 26, 2009.

UK Intellectual Property Office Examination Report, Oct. 6, 2009.

*Primary Examiner* — Rob Swiatek

(74) *Attorney, Agent, or Firm* — Joseph T. Leone, Esq.; DeWitt Ross & Stevens S.C.

(57) ABSTRACT

An equine training aid for enabling a horse, pony, donkey or the like, particularly dressage or show horses, to adopt an optimum outline or profile. The training aid includes a self-centering, continuous loop portion (1), configured, during lunging or riding, to be in contact tension with the equine wherein the continuous loop portion (1) includes a front section (1*a*) and a rear section (1*b*) each of which are linked by a linker such as the form of rings (2*a*) and pivotal clips (2*b*). Each of the loop sections (1*a*) and (1*b*) additionally has two adjustment mechanisms (e.g. sliders; (3)) to allow each loop section to be lengthened or shortened and both ends of the rear section (1*b*) terminate in a safety loop (4) which allows rotation of the device to a limited extent and prevents the rear section of the loop portion (1*b*) from slipping down the hind legs of the equine when the device is being dismantled and removed from the equine.

15 Claims, 4 Drawing Sheets

FOREIGN PATENT DOCUMENTS

| | | | |
|---|---|---|---|
| FR | 2 449 646 | A | 9/1980 |
| FR | 2 449 646 | A1 | 9/1980 |
| FR | 2 778 906 | A | 11/1999 |
| FR | 2 778 906 | A1 | 11/1999 |

* cited by examiner

EQUINE TRAINING DEVICE

The invention relates to an equine training aid for enabling a horse, pony, donkey or the like, particularly dressage or show horses, to adopt an optimum outline or profile.

It will be appreciated that the equine training aid of the present invention is equally applicable to horses, ponies and the like and references made herein to horses extend equally to other equine animals such as ponies, donkeys and the like.

According to the Federation Equestre Internationale, there are over 12 million horses owned worldwide and 27 million people ride regularly. According to American Horse Council statistics, there are 6.9 million horses in the United States of America, including both commercial and recreational horses. Almost 3 million of these are owned purely for showing and recreational purposes, and approximately 4.5 million people actively participate in showing and related recreational activities.

During events involving horses, such as dressage events, success is measured by gaining the fewest penalty points. One factor in measuring penalty points involves assessing the outline or profile which the horse adopts. One such outline or profile is known as "Topline", which is the shape that the horse makes from the top of its neck (poll) to the tail. However, not all horses move in the correct outline and accept instructions through the rider's hand and/or have flexion (a bending movement) through the poll. Thus, for a horse to be successful in dressage events it must be trained to adopt an optimum outline or profile.

A number of training aid devices are available which aim to develop or train a horse to allow it to adopt the optimum topline profile. However, there are numerous drawbacks with such devices. For example, the known devices are fixed in position and thereby function to force the horse to develop the required outline. This is clearly not desirable because such an arrangement can often cause stress and pain to the animal. Another drawback with the existing training aids is that they focus only on training the front end of the horse (the fore quarters) rather than both the fore and hind quarters. This is clearly undesirable because the horse generates power through the hind quarters and is therefore an important target for training. One further drawback with existing training aids is the requirement for rider operation by means of a separate rein whilst riding the horse which is also clearly undesirable because such an arrangement would result in complicated co-ordination of riding and training. A yet further drawback with existing training aids is the use of a complex system of pulleys which are not only complicated to fit but also require numerous adjustments, particularly when direction changes are required. There is thus a great need for an effective horse training aid which does not cause stress or pain to the horse and is simple to fit and use.

Thus, according to a first aspect of the invention there is provided an equine training aid comprising a self-centering, continuous loop portion, configured, when in use, to be in contact tension with the horse.

According to a second aspect of the invention there is provided an equine training aid comprising a self-centering, continuous loop portion, configured, during lunging or riding, to be in contact tension with the horse.

For the purposes of the invention 'contact tension' should be understood as being achieved when neither pulling nor sagging of the continuous loop occurs.

When in use, the continuous loop portion encourages the horse to adopt the desired topline profile, rather than physically forcing it to do so. The device works in such a manner because the horse prefers to reduce the tension between itself and the loop and moves of its own accord to minimise any such tension. The horse consequently chooses to position itself such that the continuous loop is at contact tension, and willingly assumes an optimum topline profile rather than actively being forced into such an outline. The invention is therefore an effective training aid, which also provides a comfortable environment within which the horse can move, and as such, is an animal friendly and holistic approach to horse training, as opposed to previously known devices.

It will be appreciated that the training aid of the present invention may be used while lunging or riding.

In the lunging embodiment, the continuous loop would generally pass, in use, substantially horizontally around the body of the horse, preferably from the head to the hindquarters. Such an embodiment will allow the forequarter and hindquarter muscles of the horse to be trained to achieve an optimum outline or profile.

It will be appreciated that the continuous loop portion may comprise one or more sections linked by joining means while still retaining the configuration of a continuous loop. The advantage of such an arrangement is that the loop can be fitted around the horse and removed easily. Furthermore, in the lunging embodiment, this allows the rear part of the loop portion to drop below the level of the front part of the loop portion without losing contact tension. Preferably, the joining means comprise a ring on one part which may be joined together by means of any suitable clips on the other part which may easily be attached and released, for example, a pivotal or swivel clip.

In the riding embodiment, the continuous loop would generally pass, in use, substantially from behind the ears (the poll) of the horse or the crest of the neck of the horse through the bit ring. Such an embodiment will allow the neck muscles to be trained to achieve an optimum outline or profile.

In a further embodiment, the equine training aid comprises more than one self-centering, continuous loop portion (preferably two), one of which is arranged, in use, to pass substantially horizontally around the body of the horse and the other of which is arranged, in use, to pass substantially from behind the ears (the poll) of the horse or the crest of the neck of the horse through the bit ring. Such an embodiment will allow the neck, forequarter and hindquarter muscles of a horse to be trained to achieve an optimum outline or profile.

In a yet further embodiment, the equine training aid additionally comprises a safety loop. The safety loop is advantageously located at both ends of the rear section of the continuous loop portion and is configured to prevent the rear section slipping down the hind legs of the horse when the device is being dismantled and removed from the horse. In the absence of such a safety loop, dismantling the device would cause it to suddenly drop, which could potentially startle the horse. The presence of the safety loop ensures that the front section of the device can be removed first while the rear section remains in place. The safety loop additionally provides the advantage of allowing rotation of the continuous loop to a limited extent during use (e.g. during lunging).

In a further embodiment, the continuous loop portion is arranged such that it is held in place during lunging or riding by a connecting portion configured to pass between the forelegs to link the loop portion to a girth or lunging roller. The connecting portion may be thought of as guides for the continuous loop rather than one or more anchors for the loop; the continuous loop is still free to rotate to a limited extent in a longitudinal manner relative to the horse. The continuous loop portion can be connected to the connecting portion by a variety of means, for example, a ring or a pivotal or swivel clip.

In a further embodiment, the continuous loop portion and connecting portion comprise one or more adjustment means to enable each portion to be lengthened or shortened to fit a variety of different sized horses and also to allow adjustment to the desired horse outline or profile. Suitably, the adjustment means comprise a buckle or slider, although any suitable device is possible.

In a further embodiment, the continuous loop portion may also be arranged, during lunging or riding to connect with or pass through one or more supporting means provided at one or more locations about the body of the horse. Examples of such supporting means include the bit ring and the lunging or breaking roller. These supporting means function solely to hold the continuous loop in place, for example, in the lunging embodiment, the continuous loop preferably passes through the 'D' rings of the lunging roller to stop the loop from sliding down the hindquarters of the horse. As with the connecting portion, the supporting means may be thought of as guides for the continuous loop rather than an anchor for the loop; the continuous loop is still free to rotate to a limited extent in a longitudinal manner relative to the horse through the supporting means.

In a further embodiment the continuous loop portion and connecting portion are constructed from natural materials such as leather or modern synthetic materials such as nylon. It will be appreciated that synthetic materials are more preferable as these are lightweight, easy to clean and less abrasive at points of contact on the horse.

According to a third aspect of the invention there is provided a method of training a horse to adopt a topline profile comprising arranging a self-centering continuous loop around the horse with the loop being of sufficient length that contact tension is achieved with the loop when the horse adopts a topline profile.

According to a fourth aspect of the invention there is provided a method of training a horse to adopt a topline profile during lunging or riding comprising arranging a self-centering continuous loop around the horse with the loop being of sufficient length that contact tension is achieved with the loop when the horse adopts a topline profile.

It is believed that a horse within a continuous loop psychologically likes to reduce tension between itself and the loop and therefore tends to position itself to minimize tension within the loop. Although the loop is held in place around the horse it is able to rotate to a limited extent in a longitudinal manner relative to the horse, which allows it to be self-centering. Thus, the loop is not attached to the horse in a manner that prevents rotation thereof.

The invention will now be described, by way of example only, with reference to the accompanying drawings in which FIG. 1 shows a plan view of the continuous loop portion of the invention which in use passes substantially horizontally around the body.

Figure 1:
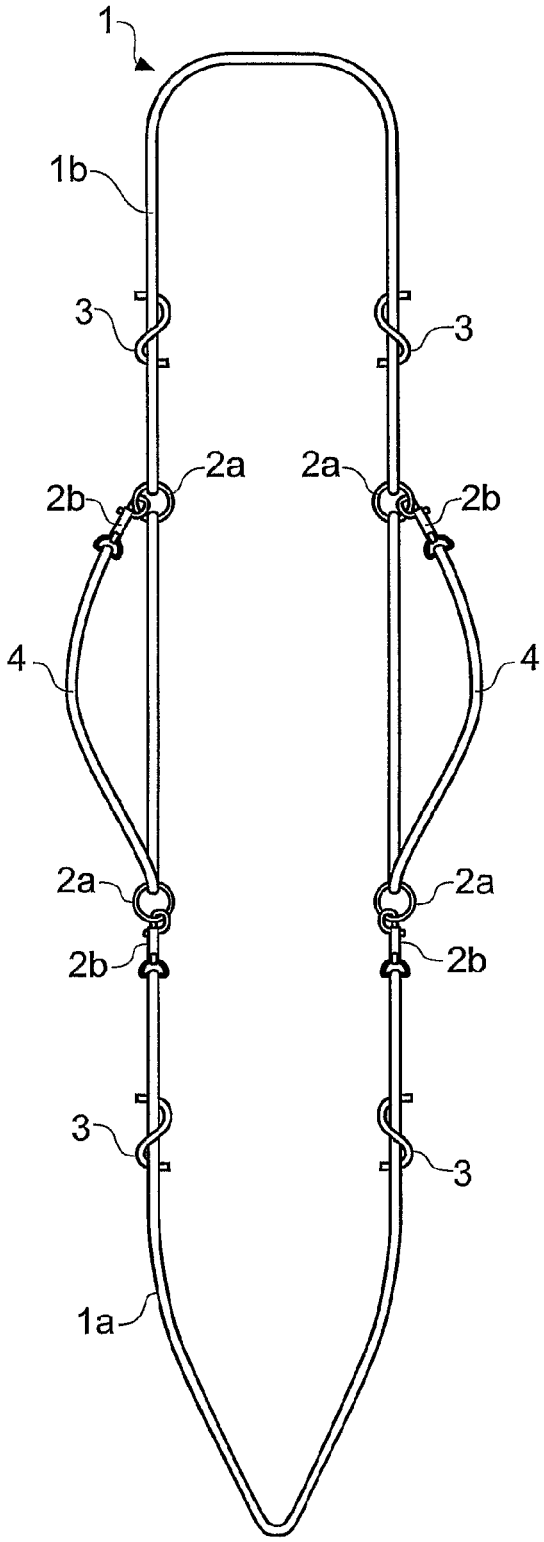

Referring first to FIG. 1, a continuous loop portion shown generally as 1, comprises a front section 1*a* and a rear section 1*b* which are linked by linking means in the form of rings 2*a* and pivotal clips 2*b* such that the overall configuration is a continuous loop. Each of the loop sections 1*a* and 1*b* additionally has two adjustment means (e.g. sliders) 3 to allow each loop section to be lengthened or shortened. Both ends of the rear section 1*b* terminate in a safety loop 4 which allows rotation of the device to a limited extent and prevents the rear section of the loop portion 1*b* from slipping down the hind legs of the horse when the front section 1*a* of the continuous loop portion 1 is dismantled and removed from the horse.

Figure 2:
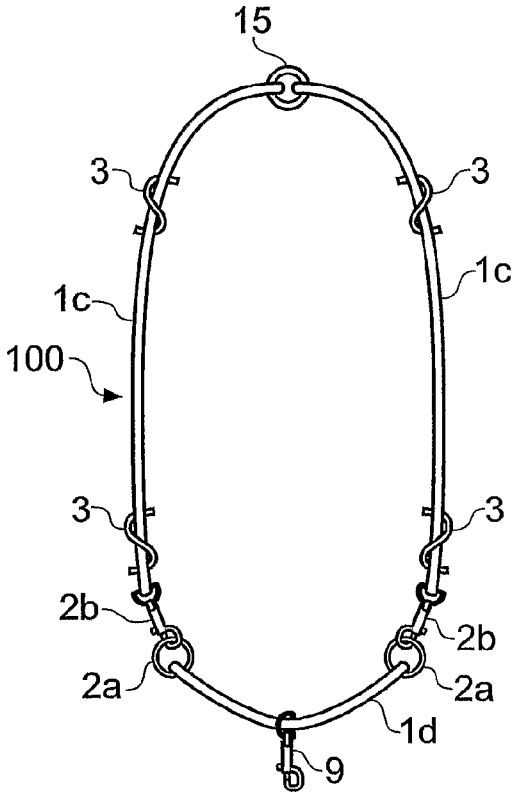
FIG. 2 shows a plan view of the continuous loop portion of the invention which in use passes substantially from the crest of the neck of the horse through the bit ring.

An additional continuous loop portion is shown in FIG. 2 as 100 and comprises two sections 1*c* linked together at one end by a ring 15. Both of the other ends of sections 1*c* are connected by pivotal clips 2*b* to two rings 2*a* on an additional section 1*d*. Each of the sections 1*c* additionally has two adjustment means (e.g. sliders) 3 to allow the loop section 100 to be lengthened or shortened. The additional section 1*d* comprises a clip 9 for attachment of the continuous loop portion 100 to the connecting portion discussed in FIG. 3.

Figure 3:
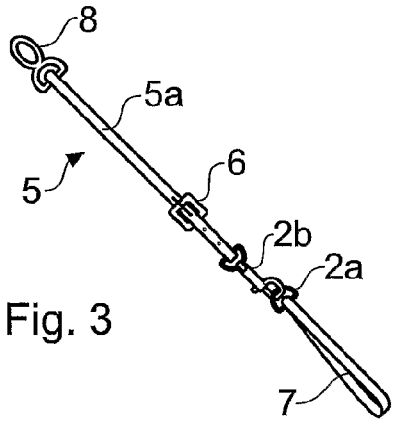
FIG. 3 shows a plan view of the connecting portion of the invention.

In FIG. 3, a connecting portion is shown generally as 5 and comprises a single section 5*a* with adjustment means (e.g. a buckle) 6 to allow the connecting portion 5 to be lengthened or shortened. The connecting section 5*a* is attached to a flattened loop section 7 at one end by a D shaped ring 2*a* and pivotal clip 2*b* and is connected at the other end to a ring 8.

Figure 4:
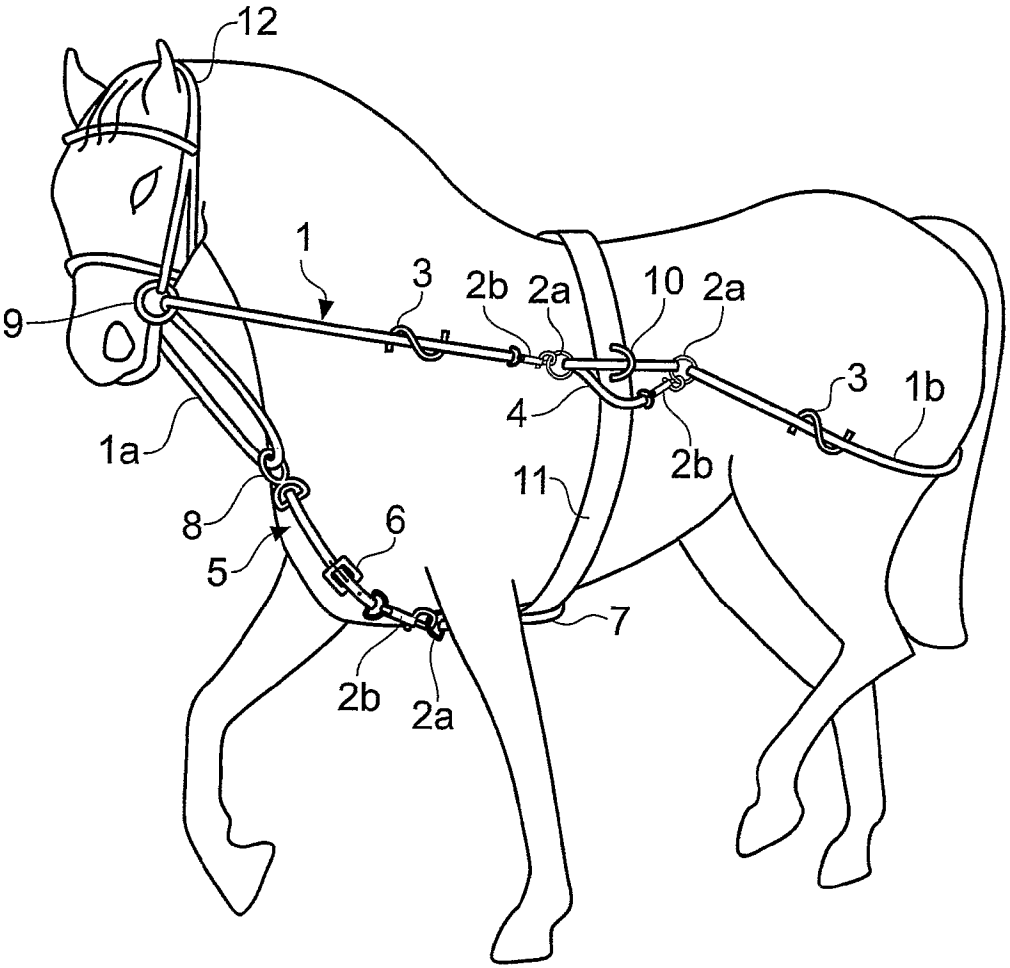
FIG. 4 shows a plan view of the portions shown in FIGS. 1 and 3 fitted to a horse in the lunging embodiment of the invention.
Figure 6:
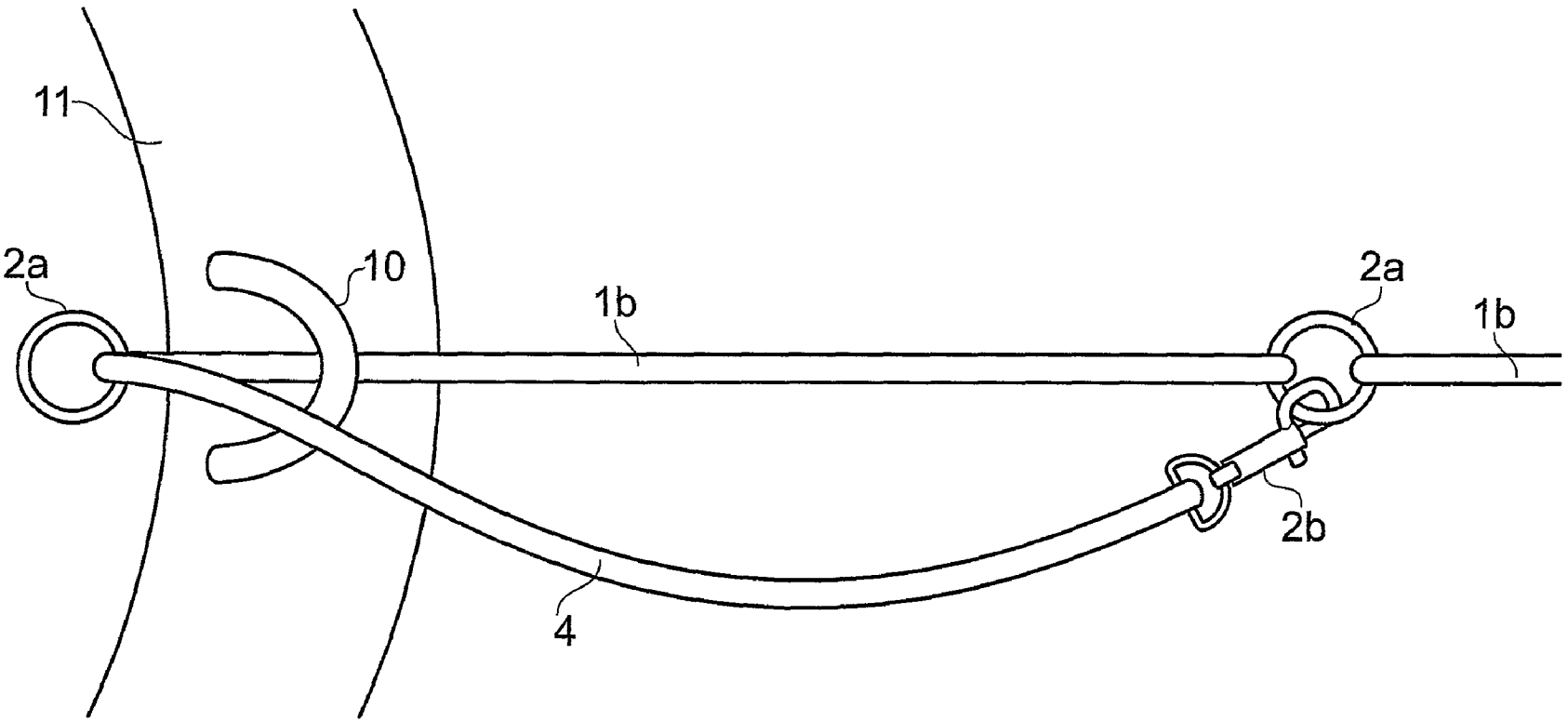
FIG. 6 shows a detailed view of the interaction of the safety loop, the continuous loop portion and the D-ring of the lunging roller shown in FIG. 4.

In use, during lunging for example, FIG. 4 shows a horse wearing a conventional snaffle bridle 12 fitted around the head of the horse and connected to a bit ring 9. The continuous loop portion 1 described in FIG. 1 passes substantially horizontally around the body of the horse. The rear section 1*b* of the continuous loop portion 1 passes through the D-ring 10 of the lunging roller 11 and the safety loop 4 passes over the D-ring 10 and attaches, for example, to ring 2*a* of the rear section 1*b* to allow self-centering and rotation of the continuous loop portion to a limited extent during use and to prevent the rear section of the loop portion 1*b* from slipping down the hind legs of the horse when the front section 1a of the continuous loop portion 1 is dismantled and removed from the horse. A more detailed view of the interaction between the rear section 1*b* of the continuous loop portion 1 and the D-ring 10 of the lunging roller 11 is shown in FIG. 6.

The front section 1*a* of the continuous loop portion 1 passes through both bit rings 9 of the horse (only one is shown in Figures) and passes through the ring 8 of the connecting portion 5. This connecting portion 5 passes between the forelegs of the horse and is linked to the lunging roller 11 by the flattened loop section 7.

Figure 5B:
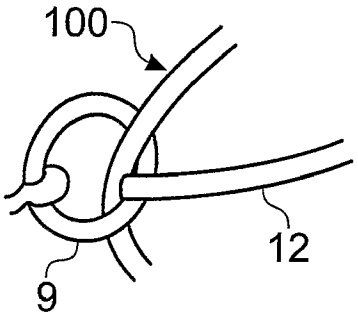
FIG. 5B shows a detailed view of the interaction of the continuous loop portion and snaffle bridle shown in FIG. 5A.
Figure 5A:
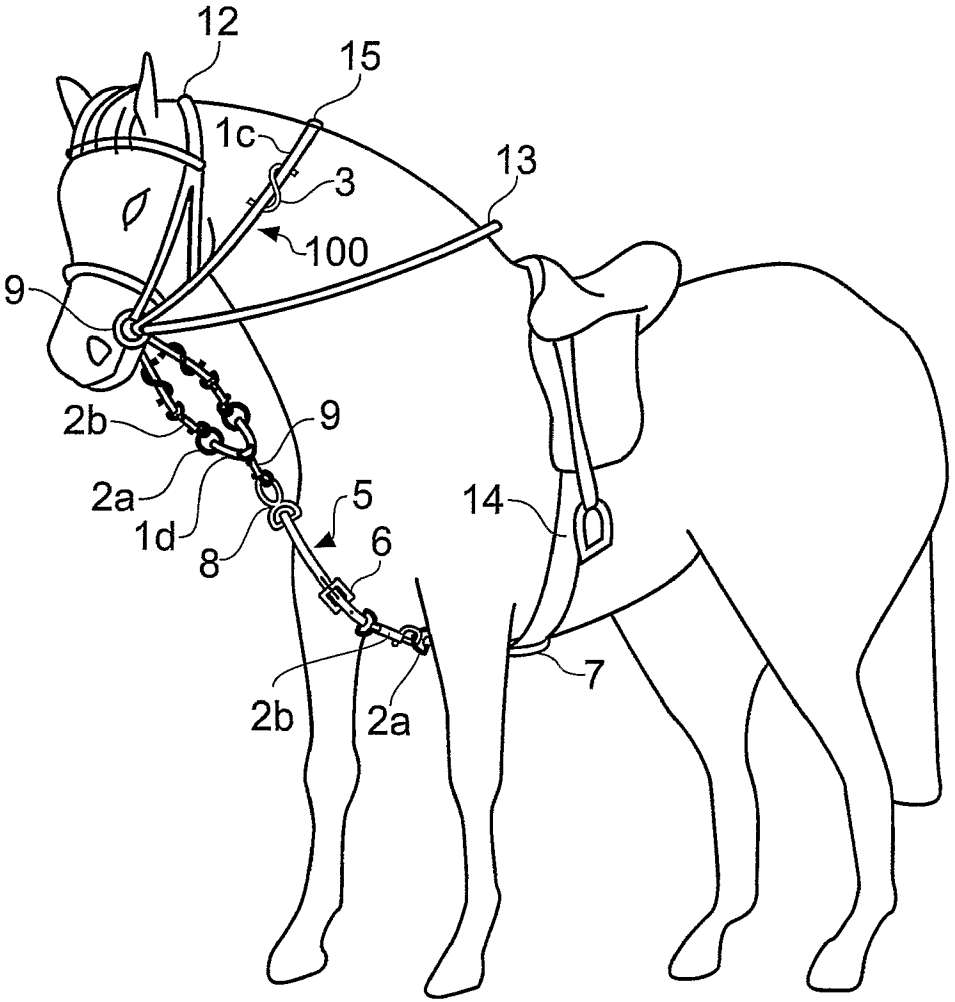
FIG. 5A shows a plan view of the portions shown in FIGS. 2 and 3 fitted to a horse in the riding embodiment of the invention.

In use, during riding for example, FIG. 5A shows a horse wearing a conventional snaffle bridle 12 fitted around the head of the horse and reins 13, both of which are connected to both bit rings 9 (only one is shown in Figures). The continuous loop portion 100 described in FIG. 2 passes substantially from the crest of the neck of the horse (shown in FIG. 5A by the ring 15) and passes through both bit rings 9 and is connected to the ring 8 of the connecting portion 5 described in FIG. 3 by the clip 9 as described in FIG. 2. The connecting portion 5 passes between the forelegs of the horse and is linked to the girth 14 by the flattened loop section 7. The presence of the additional section 1*d* allows self-centering and rotation of the continuous loop portion 100 to a limited extent during use. For example, movement of the continuous loop portion is allowed by the additional section 1*d* but is restricted and centered by the presence of the rings 2*a* and the connecting portion 5.

FIG. 5B demonstrates how the continuous loop portion 100 passes through the bit ring 9 of the snaffle bridle 12.

The invention claimed is:

1. A training aid comprising a continuous loop portion, configured to be free to rotate horizontally around the body of an equine and to slidingly connect with or pass through one or more bit rings and held in place by a connecting portion configured to pass between the forelegs to link the loop portion to a girth or lunging roller and the continuous loop portion and the connecting portion comprising one or more adjustment means to enable each portion to be lengthened or shortened to allow adjustment so neither pulling nor sagging of the continuous loop portion occurs.

2. A training aid as defined in claim 1 wherein the continuous loop portion is arranged to pass, in use, substantially horizontally around the body of the equine from the head to the hindquarters connecting with or passing through one or more supporting means provided at one or more sites around the body of an equine.

3. A training aid as defined in claim 2 wherein the one or more supporting means comprise D-rings of a lunging roller.

4. A training aid as defined in claim 1 wherein the continuous loop portion is arranged to pass, in use, substantially from behind the ears of the equine or the crest of the neck of the equine.

5. A training aid as defined in claim 1 wherein the continuous loop is arranged, in use, to pass through 'D' rings of a lunging roller.

6. A training aid as defined in any one of claims 1, 2, 4, and 5 wherein the continuous loop portion comprises a plurality of sections linked by joining means.

7. A training aid as defined in claim 6 wherein said sections are configured to interact with one or more supporting means to allow self-centering and free rotation of the continuous loop portion to a limited extent.

8. A training aid as defined in claim 6 further comprising a plurality of safety loops reversibly attached to the continuous loop section, wherein the safety loops and at least one of said one or more sections forms a loop around one or more supporting means.

9. An equine training aid as defined in claim 1 comprising more than one rotatable and self-centering continuous loop portion.

10. An equine training aid comprising more than one rotatable and self-centering continuous loop portion, configured, during lunging or riding, to be in contact tension with the equine, wherein one of said loop portions is arranged to pass, in use, substantially horizontally around the body of the equine and the other of which is arranged to pass, in use, substantially from behind the ears of the equine or the crest of the neck of the equine to the lower head and neck region of the equine.

11. An equine training aid as defined in claim 9 comprising one or more adjustment means to enable the loop and connecting portions to be lengthened or shortened.

12. An equine training aid as defined in claim 1 wherein the loop and connecting portions are constructed from synthetic materials such as nylon.

13. A method of training an equine to adopt a topline profile during lunging or riding comprising arranging a continuous loop portion around the equine, the continuous loop portion configured to be free to rotate horizontally around the body of the equine and to slidingly connect with or pass through one or more bit rings and be held in place by a connecting portion configured to pass between the forelegs to link the loop portion to a girth or lunging roller and the continuous loop portion and the connecting portion comprising one or more adjustment means to enable each portion to be lengthened or shortened to allow adjustment so neither pulling nor sagging of the continuous loop occurs, and adjusting the continuous loop portion and the connecting portion so neither pulling nor sagging of the continuous loop occurs so that the equine adopts a topline profile.

14. An equine training aid comprising more than one rotatable and self-centering continuous loop portion, configured, during lunging or riding, to be in contact tension with the equine, wherein one continuous loop portion is arranged to pass, in use, substantially horizontally around the body of the equine from the head to the hindquarters, and wherein a second continuous loop portion is arranged to pass, in use, substantially from behind the ears of the equine or the crest of the neck of the equine to the lower head and neck region of the equine, and further which is arranged, in use, to connect with or pass through one or more supporting means provided at one or more locations about the body of the equine.

15. An equine training aid as defined in claim 14 wherein the continuous loop portions are arranged, in use, to pass through 'D' rings of a lunging roller, or to pass through one or more bit rings.

* * * * *